United States Patent [19]

Vaughan, Jr.

[11] Patent Number: 4,509,753

[45] Date of Patent: Apr. 9, 1985

[54] HIDDEN PASSAGE BALL PUZZLE

[76] Inventor: Philip M. Vaughan, Jr., P.O. Box 925, Woodstock, N.Y. 12498

[21] Appl. No.: 467,146

[22] Filed: May 23, 1983

[51] Int. Cl.[3] ..... A63F 7/04

[52] U.S. Cl. ..... 273/110; 273/116

[58] Field of Search ..... 273/113, 115, 116, 138 R, 273/120 R, 110

[56] References Cited

U.S. PATENT DOCUMENTS

| | | | |
|---|---|---|---|
| 509,362 | 11/1893 | Casler | 273/115 |
| 679,782 | 8/1901 | Reenstierna | 273/113 |
| 3,592,471 | 7/1971 | Swimmer | 273/120 R |
| 3,610,628 | 10/1971 | Promin | 273/138 R |
| 3,747,937 | 7/1973 | Fabricani | 273/153 R |
| 4,376,537 | 3/1983 | Yokoi | 273/153 S |

FOREIGN PATENT DOCUMENTS

| | | | |
|---|---|---|---|
| 2027597 | 2/1980 | United Kingdom | 273/113 |

*Primary Examiner*—Richard C. Pinkham
*Assistant Examiner*—Scott L. Brown

[57] ABSTRACT

The Pyramid Puzzle is a toy puzzle incorporating a ball hidden inside a pyramid. By chance rotation of the various levels of the pyramid the ball drops through the levels of the pyramid. When the ball falls into a blind (partial) hole, the pyramid must be manipulated to re-orient the ball so that it may fall freely down to the next level. The puzzle is solved by retrieving the ball in a sliding tray at the base of the pyramid.

7 Claims, 24 Drawing Figures

HIDDEN PASSAGE BALL PUZZLE

BRIEF SUMMARY OF INVENTION

The Pyramid Puzzle is a wooden toy puzzle in the shape of a pyramid whose base is 5" on each of four sides and whose height is $4\frac{1}{2}$". The wooden pyramid is not one block of wood but is composed of eight layers of wood (including a cap) stacked onto each other, The top and bottom layers (the cap and base respectively) are fixed (glued) onto a $\frac{1}{4}$" central dowel, while the remaining six layers may be freely rotated around the dowel. Except for the birch dowel and the white pine cap the pyramid is made entirely for aromatic red cedar.

Hidden from view and inside the wooden Pyramid Puzzle are a series of holes drilled through each layer allowing for the passage of a small "golden nugget" (ball) from one layer to the next. Each wooden layer contains from one to three partially drilled or blind holes and one completely drilled-through hole. The object is to solve the puzzle by manipulating the wooden layers into position to allow the ball to fall through each layer until it comes to rest in a partially drilled cavity in a slide at the base of the pyramid. The slide is slotted to allow it to travel out and away from one side of the pyramid and only out so far as to expose the ball. If during the travel through the levels the ball falls into a blind hole, the pyramid must be turned over and the proper level rotated until the ball falls out. Turned back over, it is free to travel through the completely drilled holes. Therefore in a series of trial and error motions, at the same time listening to determine whether or not the ball has fallen into a blind or drilled-through hole, the ball reaches the cavity in the slide at the base of the pyramid and the puzzle is solved.

BRIEF DESCRIPTION OF DRAWINGS:

There are six (6) sheets of drawings as follows.

Sheet 1 of 6 contains FIG. 1 and FIG. 2.

Sheet 2 of 6 contains FIG. 3 and FIG. 4.

Sheet 3 of 6 contains FIGS. 5 through 9.

Figure 10:
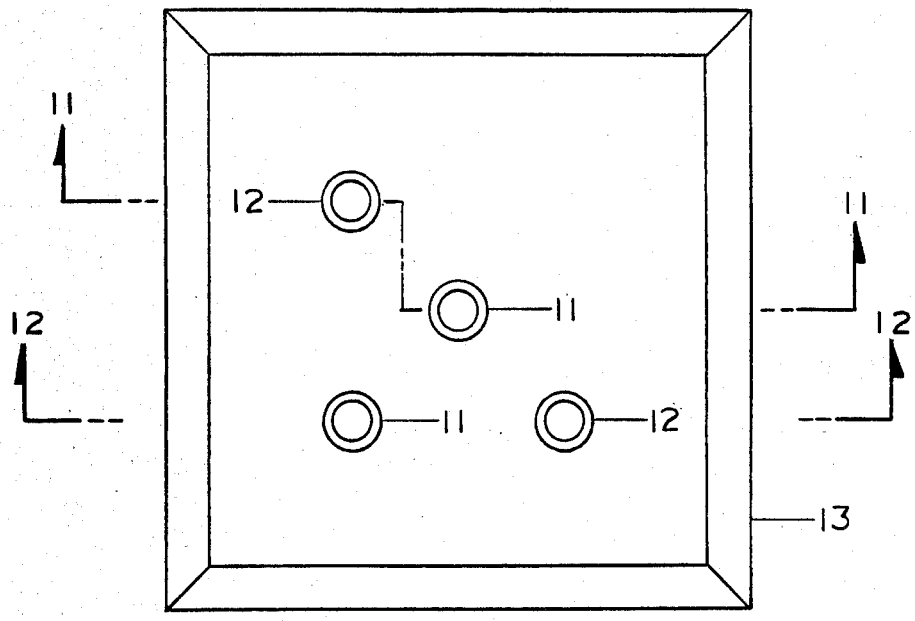
Figure 11:
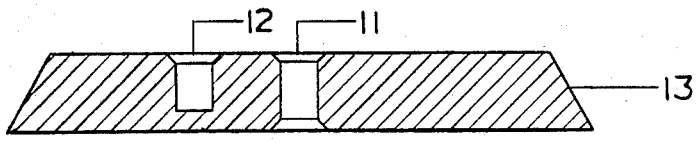
Figure 12:
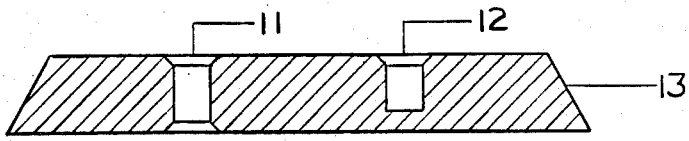

Sheet 4 of 6 contains FIGS. 10, 11 and 12 which are cross sections and plan (side) views respectively of Level 3 which contains drilled through and blind holes.

Figure 13:
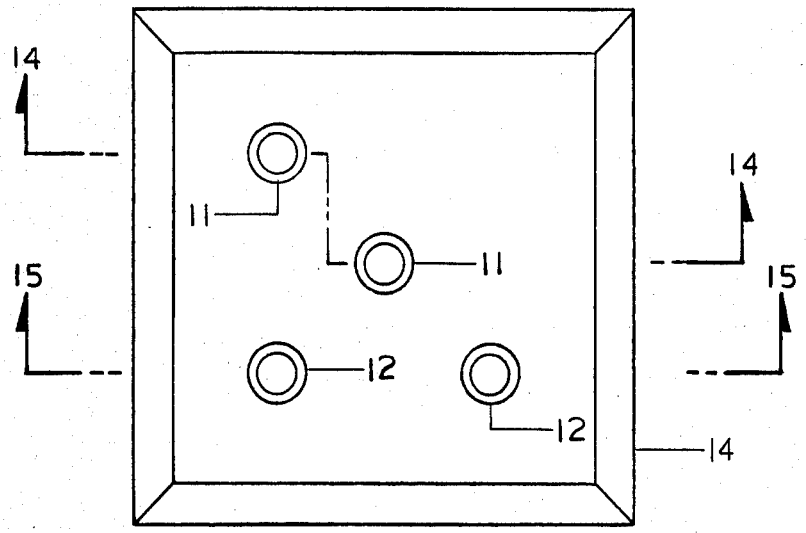
Figure 14:
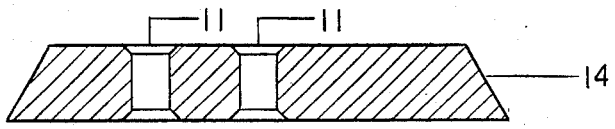
Figure 15:
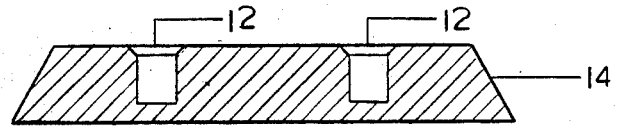
Figure 16:
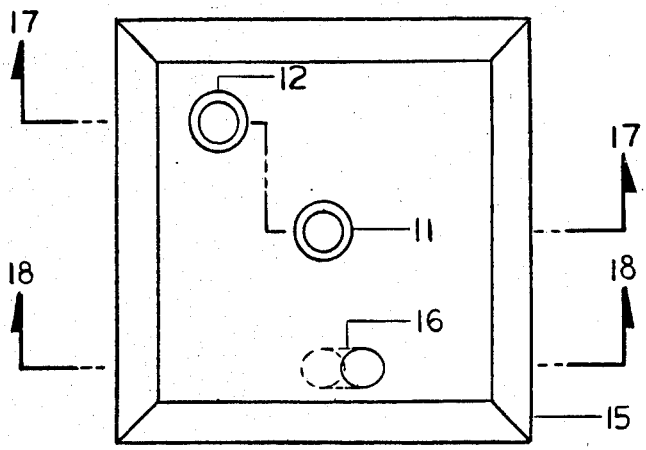
Figure 17:
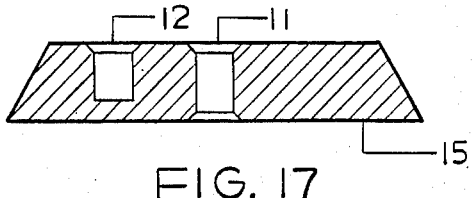
Figure 18:
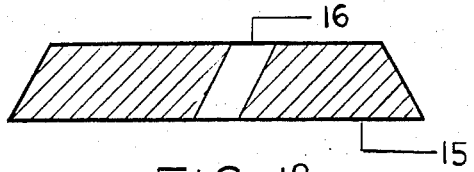

Sheet 5 of 6 contains FIGS. 13 through 18. FIGS. 13, 14 and 15 are cross section and plan (side) views respectively of Level 4 which contains drilled through and blind holed. FIGS. 16, 17 and 18 are cross section and plan (side) views respectively of Level 5 which contains an angled drilled-through hole and one blind hole.

Figure 19:
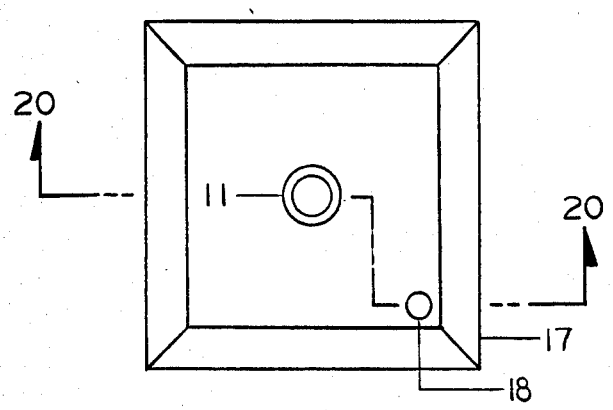
Figure 20:
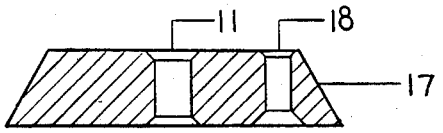
Figure 21:
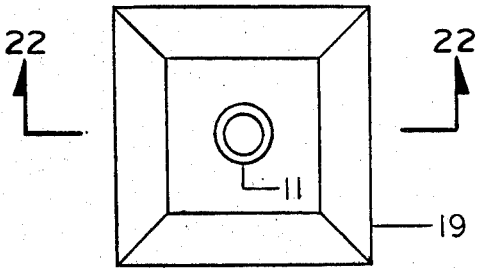
Figure 22:
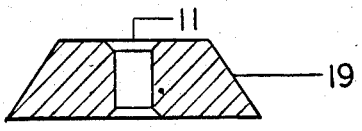
Figure 23:
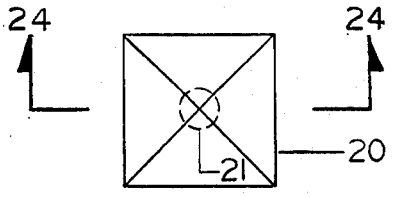
Figure 24:
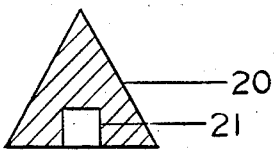

Sheet 6 of 6 contains FIGS. 19 through 24. FIGS. 19 and 20 are cross section and plan (side) views of Level 6 showing the hold into which the ball is first deposited into the pyramid. FIGS. 21 and 22 are cross section and plan (side) view of Level 7. FIGS. 23 and 24 are plan (top and side respectively) views of the cap (top) of the pyramid puzzle.

DETAILED DESCRIPTIONS

The Pyramid Puzzle is a wooden toy puzzle. The fact that it is made of wood has little significance. Wood is readily available and easily worked. Red cedar, a relatively inexpensive soft wood, was desired for texture, grain, color and light weight. Indeed, the value of the toy might be enhanced by using a variety of hardwoods. Further, the Pyramid Puzzle will more than likely be mass-marketed in plastic and in a variety of colors.

Figure 3:
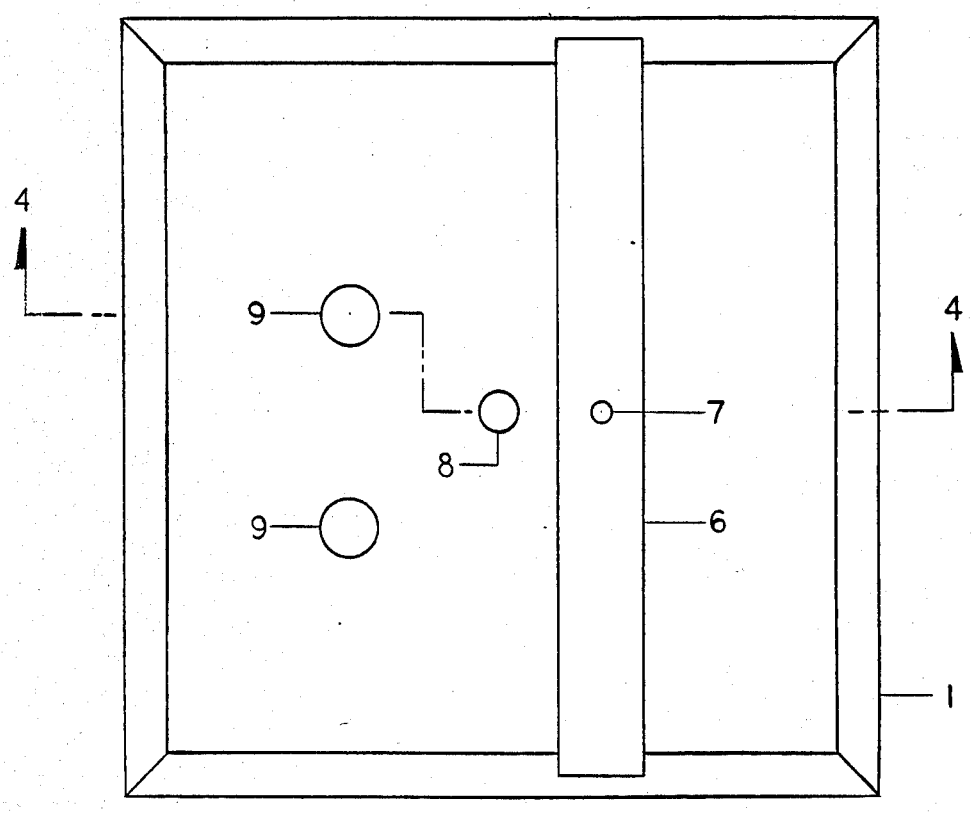
FIG. 3 is a cross section of the base (level 1) of the pyramid.
Figure 4:
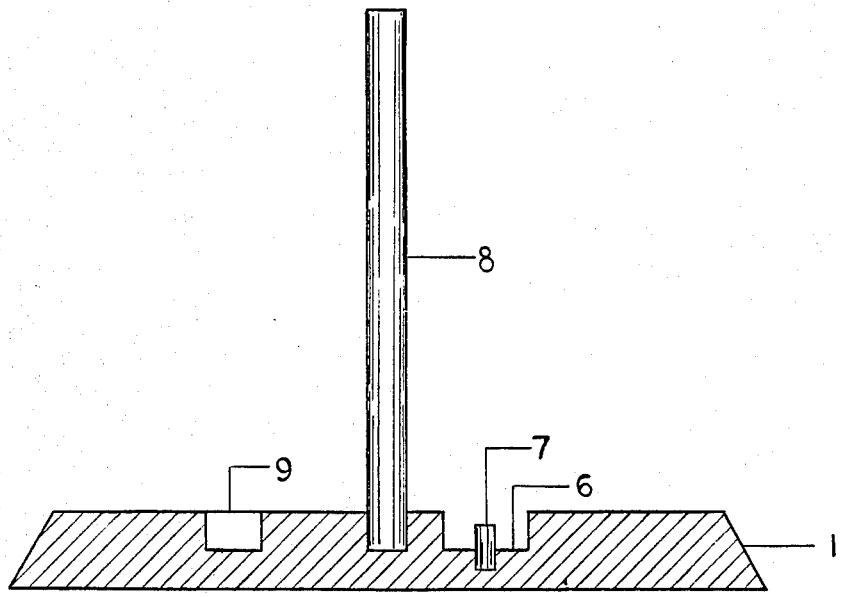
FIG. 4 is a longitudinal view of the same pyramid base showing the central dowel.
Figure 5:
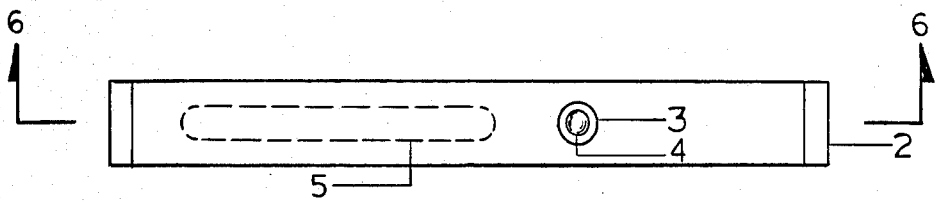
FIGS. 5 and 6 are plan views (top and side respectively) of the slide containing the ball.
Figure 6:
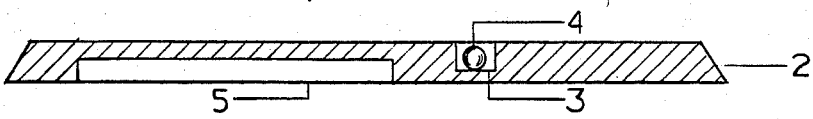
Figure 7:
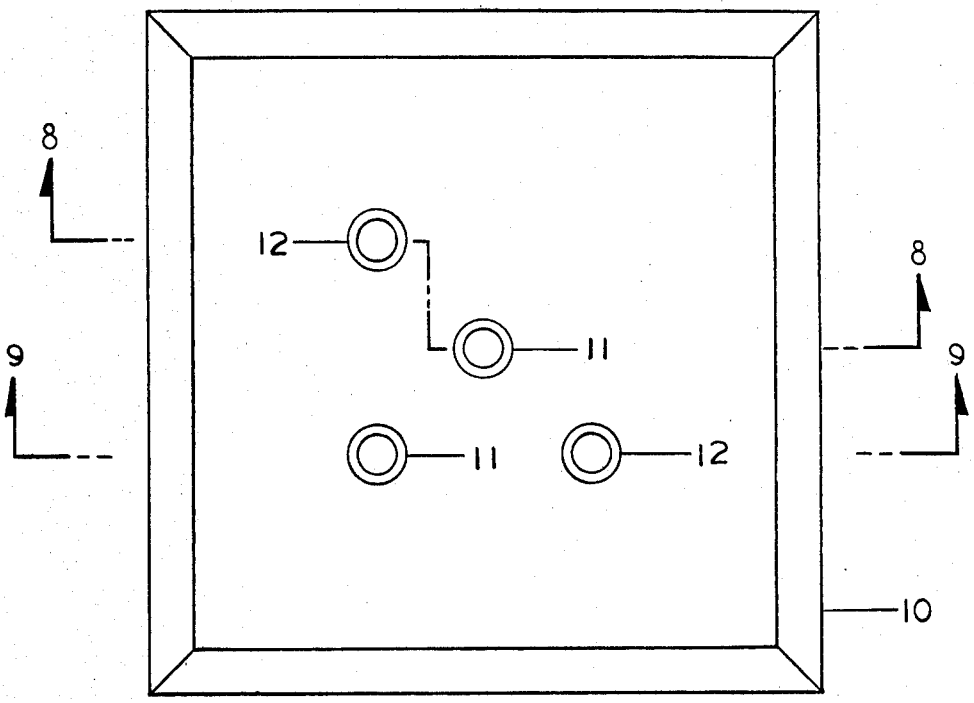
FIGS. 7, 8 and 9 are cross sections and plan (side) views respectively of level 2 which contains drilled-through and blind holes.
Figure 8:
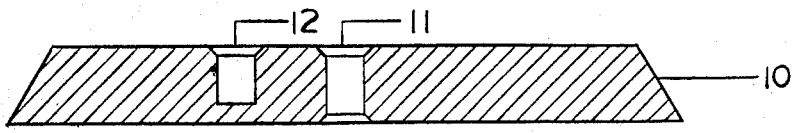
Figure 9:
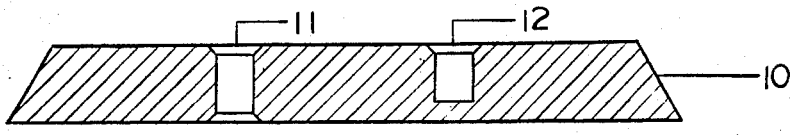

The process by which the (wooden) pyramids are manufactured and assembled is as follows:

Rough #2 red cedar is selected for uniformity of grain, color, texture and low moisture content. Purchased in thicknesses of $\frac{3}{4}$" (normally in 6" to 12" widths by 8' to 20' lengths) the lumber is planed smooth on both sides to approximately $\frac{1}{2}$" thick in a thickness planer. Using a table circular saw the planed lumber is sawn into seven squares (layers or levels) of the following dimensions:

Level 1 (Base) $\frac{1}{2}$"×5"×5"—FIGS. 3 and 4.
Level 2 $\frac{1}{2}$"×$4\frac{1}{2}$"×$4\frac{1}{2}$"—FIGS. 7, 8, and 9.
Level 3 $\frac{1}{2}$"×$3\frac{7}{8}$"×$3\frac{7}{8}$"—FIGS. 10, 11 and 12.
Level 4 $\frac{1}{2}$"×$3\frac{1}{4}$"×$3\frac{1}{4}$"—FIGS. 13, 14 and 15.
Level 5 $\frac{1}{2}$"×$2\frac{3}{4}$"×$2\frac{3}{4}$"—FIGS. 16, 17 and 18.
Level 6 $\frac{1}{2}$"×$2\frac{1}{4}$"×$2\frac{1}{4}$"—FIGS. 19 and 20.
Level 7 $\frac{1}{2}$"×$1\frac{5}{8}$"×$1\frac{5}{8}$"—FIGS. 21 and 22.

Figure 1:
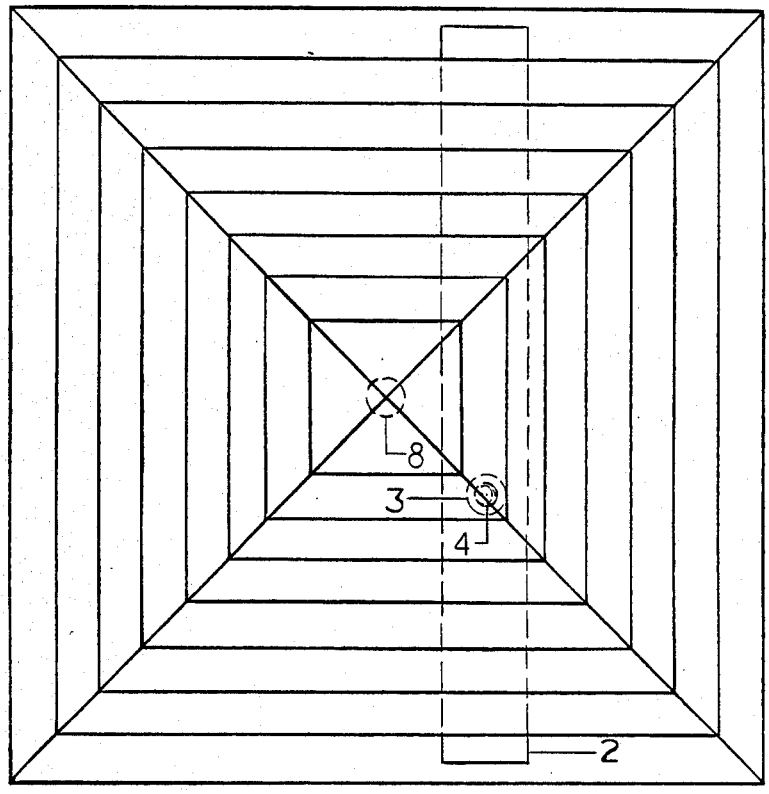
FIG. 1 is a plan view looking at the Pyramid Puzzle from the top to show the assembled pyramid and the hidden slide containing the ball.
Figure 2:
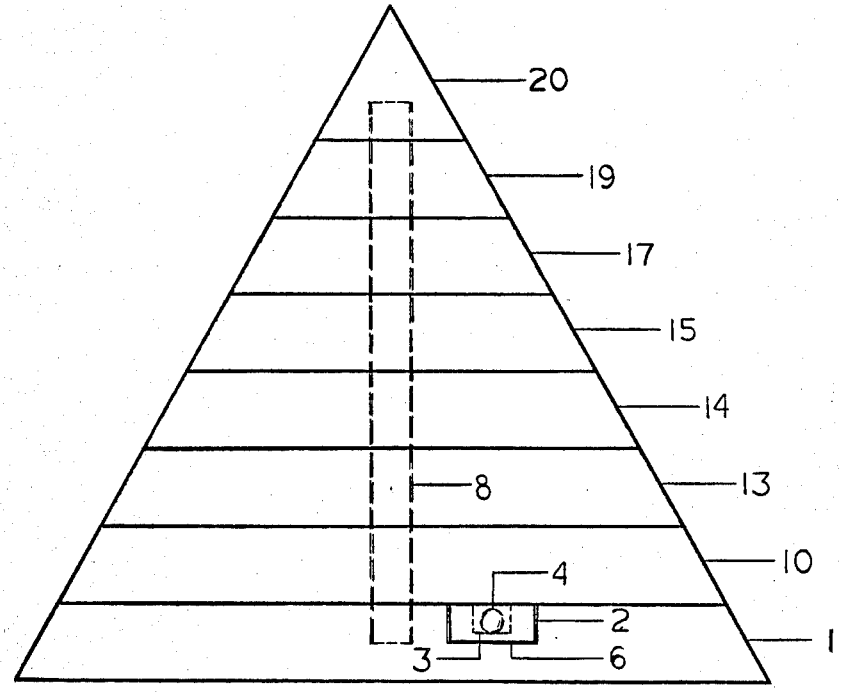
FIG. 2 is a longitudinal view showing the pyramids' basic shape and the central dowel around which the levels rotate.

The four sides of each square (level) are beveled to a 60° angle, the purpose of which is to form a pyramid by stacking the successively smaller layers (levels) onto one another, the largest level (the base of the pyramid) being on the bottom. (FIGS. 1 and 2). The cap 20 of the pyramid is cut and beveled from commercially available 5/4" white pine to 1"×$1\frac{1}{8}$"×$1\frac{1}{8}$" to be placed onto level seven 19 to bring the pyramid to a point.

A 17/64" hole is bored in the exact center of levels 2 through 7 so that they may be easily rotated around a $\frac{1}{4}$" birch dowel 8 when glued into the pyramid's base 1 (level 1) and the cap. One quarter inch holes are partially drilled in the base of the pyramid and the cap 20 so that the $\frac{1}{4}$" dowel 8 will be a tight fit when glued.

The base 1 of the pyramid has a feature found in no other level. It contains a secret compartment or a drilled cavity 3 in a slip of wood 2 designed to slide in and out of a groove 6 in the base 1 of the pyramid. The ends of this slide 2 are beveled to a 60° angle to conform to the bevel of the base 1 of the pyramid. The underside of the slide 2 is slotted 5 (routed) $\frac{1}{8}$" deep×3/32" wide for a length of $1\frac{3}{4}$".

The base 1 of the pyramid must therefore be slotted 6 (a dado blade was used in a table circular saw) its entire width, the centerline of the slot 6 being a distance of $\frac{3}{4}$" from the exact center of the pyramid. The slot 6 is cut $\frac{1}{4}$" deep by 9/16" wide by $4\frac{3}{4}$" long to accommodate the slide 2 of the same dimensions. A hole 3/32" in diameter is drilled 5/32" deep in the center of the excavated slot 6 (of the base 1) and a $\frac{1}{4}$" long bamboo dowel of approximately 3/32" diameter is driven into the hole. This peg 7 which protrudes from the hole approximately 3/32" is stationery in the base 1 and allows the slotted slide 2 to travel over it and also provides a stop to cease the travel motion at the exact point where the partially drilled cavity 3 in the top of the slide 2 appears at the edge of the base 1 of the pyramid.

All of the holes 11 and 12 (except for the center pivot hole through which the dowel 8 passes) drilled in levels 1 through 6, no matter what size or direction, are drilled at the same radius (1") or distance from the center of the pyramid. This provides for the travel of the ball 4 through the levels if they are properly alligned. The exact location and size of the holes 11 drilled in levels 1 through 6 may be seen in Sheets 2 through 6. Note that levels 1, 2, 3 and 4 contain two blind or partially drilled 5/16" holes 12 and one drilled-through 5/16" hole 11. Level five 15 contains one blind 5/16" hole 12 and a 1/16" hole 16 drilled completely through at a 60° angle. The purpose of this hole 16 is to foil any attempt to visually follow the ball through each level. (FIG. 18). Level six 20 contains one hole 18 drilled through. This is the hole and level into which the ball is originally placed to begin solving the puzzle. Level seven 19 has no holes (except for the center hole). It's function is to close over the hole in level six 20 to keep the ball from falling out of the pyramid and becoming lost.

The assembly is simple. The slotted slide 2 is fitted over the peg 7 in the slot 6 of the base 1. A ¼" diameter birch dowel 8 3 9/16" long is driven and glued into the base 1. Levels 2, 3, 4, 5, 6 and 7 are placed in that order onto the dowel loose. Glue is applied to the tip of the dowel 8 and the cap 20 is forced down over level 7 so that its base is in perfect alignment with the base 1 of the pyramid (level 1) The pyramid is then finish sanded (no sealers or other finishes are applied) and a ball placed in the secret compartment of the slide at the base of the pyramid.

The directions to use the Pyramid Puzzle are as follows:

THE PYRAMID PUZZLE

The Pyramid Puzzle is a game of trial, error and skill. It will test and heighten your sensory perception. By manuevering and listening, you will find your way through the pyramid.

A small "golden nugget" (ball) is entombed in the secret compartment at the base of the pyramid. Remove the ball and place it in the 3rd Level of the pyramid. Now you are ready to begin the challenge of The Pyramid Puzzle.

Rotate each level of the pyramid slowly. Listen for the sound of the ball as it drops into the next chamber. But be careful! The ball may become trapped in one of the several blind holes built into the pyramid. Each level has at least one blind hole; most have two.

If the ball is trapped, the pyramid must be turned over and the proper level rotated to get the ball out of the blind hole.

After you have succeeded in getting the ball out of the blind hole, continue to rotate each level until you think you have captured the ball in the secret compartment at the base of the pyramid. If you find the ball in the secret chamber you have solved the Pyramid Puzzle. If not, keep trying!

I claim:

1. A puzzle game comprising, (a) a base, a top piece and a plurality of intermediate levels wherein the said intermediate levels are parallel with and rotatable about an axis relative to said base, (b) said intermediate levels have at least one hole through said level and capable of aligning with the hole of an adjacent level providing a pathway, through the puzzle, (c) all said intermediate levels except the top level of said intermediate levels, and said base have holes extending into each level but not through said levels and the partial holes being capable of alignment with said holes forming the pathway, (d) a ball capable of traversing said pathway, (e) one of said partial holes in said base having means to indicate passage of said ball.

2. The puzzle game of claim 1 wherein said base, levels and top form a pyramid.

3. The puzzle game of claim 1 wherein one of said holes forming the pathway is at an angle with respect to the other holes so the ball cannot be visually followed through the puzzle.

4. The puzzle game of claim 1 wherein said means to indicate passage of the ball is a slide communicating with said hole and capable of being slid out bearing the ball if present.

5. The puzzle of claim 1 wherein said puzzle game is made primarily from cedar.

6. The puzzle game of claim 5 wherein said levels are made of cedar.

7. The puzzle game of claim 6 wherein a secondary level is positioned between said top and the first intermediate level and said secondary level has no holes preventing the loss of the ball.

* * * * *